US009387565B2

(12) United States Patent
Haywood

(10) Patent No.: US 9,387,565 B2
(45) Date of Patent: Jul. 12, 2016

(54) ABRASIVE APPARATUS AND COMPONENTS THEREOF

(71) Applicant: ALDERSON (NZ) LIMITED, Auckland (NZ)

(72) Inventor: John Anthony Haywood, Helensville (NZ)

(73) Assignee: ALDERSON (NZ) LIMITED, Auckland (NZ)

( * ) Notice: Subject to any disclaimer, the term of this patent is extended or adjusted under 35 U.S.C. 154(b) by 0 days.

(21) Appl. No.: 14/365,402

(22) PCT Filed: Dec. 11, 2012

(86) PCT No.: PCT/NZ2012/000230
§ 371 (c)(1),
(2) Date: Jun. 13, 2014

(87) PCT Pub. No.: WO2014/007646
PCT Pub. Date: Jan. 9, 2014

(65) Prior Publication Data

US 2014/0378033 A1 Dec. 25, 2014

(30) Foreign Application Priority Data

Dec. 13, 2011 (NZ) ..... 597072
Apr. 2, 2012 (NZ) ..... 599163

(51) Int. Cl.
*B24B 23/00* (2006.01)
*B24B 23/02* (2006.01)
(Continued)

(52) U.S. Cl.
CPC ..... *B24B 23/005* (2013.01); *B24B 7/184* (2013.01); *B24B 23/02* (2013.01); *B24B 55/02* (2013.01); *B24D 5/00* (2013.01); *B24D 7/00* (2013.01)

(58) Field of Classification Search
CPC ..... B24B 23/005; B24B 7/184; B24B 23/02; B24B 55/02; B24B 1/00; B24B 55/03; B24B 23/028; B24B 45/006; B24B 23/026; B23Q 11/10; B24D 5/00; B24D 7/00; B27B 33/08; B26D 7/2621; Y10T 83/8791; Y10T 83/9377; Y10T 83/9379
USPC ..... 451/67, 449, 488, 359, 541, 542, 450
See application file for complete search history.

(56) References Cited

U.S. PATENT DOCUMENTS 2,284,738 A * 6/1942 Hurst ..... 451/532
2,286,208 A * 6/1942 Kirchner ..... 451/538
(Continued)

FOREIGN PATENT DOCUMENTS

EP 1800801 6/2007
EP 1961518 A1 * 8/2008 ..... B24B 23/02
(Continued)

OTHER PUBLICATIONS

International Search Report, PCT/NZ2012/000230, May 17, 2013.
(Continued)

*Primary Examiner* — George Nguyen
(74) *Attorney, Agent, or Firm* — Young & Thompson

(57) ABSTRACT

Provided is an abrasive apparatus with a drive shaft terminating with a working head, where this working head is removably attach to an abrasive attachment. Also provided is a drive system arranged to rotate the drive shaft, the drive system being connected to the drive shaft distal from the working head. The abrasive apparatus also includes at least one fluid supply conduit having an inlet and at least one outlet, with the at least one outlet being located adjacent to the working head of the drive shaft and arranged to deliver fluid to the abrasive attachment and/or an immediate working area.

10 Claims, 4 Drawing Sheets

(51) Int. Cl.

| | |
|---|---|
| ***B24D 7/00*** | (2006.01) |
| ***B24B 55/02*** | (2006.01) |
| ***B24D 5/00*** | (2006.01) |
| ***B24B 7/18*** | (2006.01) |

(56) References Cited

U.S. PATENT DOCUMENTS

| | | | | | |
|---|---|---|---|---|---|
| 2,294,064 | A | | 8/1942 | Amstuz | |
| 2,899,781 | A | * | 8/1959 | Williams | 451/450 |
| 3,027,625 | A | * | 4/1962 | Milstead | 407/11 |
| 3,082,524 | A | * | 3/1963 | Schaeffer | 30/347 |
| 3,334,451 | A | * | 8/1967 | Hutton | 451/450 |
| 3,343,308 | A | * | 9/1967 | Fessel | 451/542 |
| 3,460,292 | A | * | 8/1969 | Ferchland | 451/124 |
| 3,508,890 | A | * | 4/1970 | Fontanella | B24D 11/005 428/621 |
| 3,645,310 | A | * | 2/1972 | Hartley | 241/85 |
| 3,706,252 | A | * | 12/1972 | Hawkes et al. | 83/471.2 |
| 3,799,167 | A | * | 3/1974 | Miller | A61F 13/4755 604/370 |
| 3,875,703 | A | * | 4/1975 | Clemente | 451/359 |
| 3,933,514 | A | * | 1/1976 | Banks et al. | 106/602 |
| 4,038,787 | A | * | 8/1977 | Bianchi | A41D 19/01594 15/227 |
| 4,288,233 | A | * | 9/1981 | Wiand | 51/295 |
| 4,459,782 | A | * | 7/1984 | Palmer | 451/303 |
| 4,484,417 | A | * | 11/1984 | Klingerman | 451/53 |
| 4,523,411 | A | * | 6/1985 | Freerks | 451/357 |
| 4,637,370 | A | * | 1/1987 | Ishizuka | 125/15 |
| 4,657,428 | A | * | 4/1987 | Wiley | 403/359.3 |
| 4,780,992 | A | | 11/1988 | McKervey | |
| 4,951,423 | A | | 8/1990 | Johnson | |
| 5,170,595 | A | * | 12/1992 | Wiand | 451/538 |
| 5,201,785 | A | * | 4/1993 | Nagano | 451/508 |
| 5,454,752 | A | * | 10/1995 | Sexton et al. | 451/548 |
| 5,582,541 | A | | 12/1996 | Hutchins | |
| 5,807,161 | A | * | 9/1998 | Manor et al. | 451/442 |
| 6,227,959 | B1 | * | 5/2001 | Beaudry | 451/526 |
| 6,408,480 | B1 | | 6/2002 | Wiemann | |
| 6,482,308 | B1 | * | 11/2002 | Wiemann | B24B 19/26 205/222 |
| 8,430,724 | B2 | * | 4/2013 | Heilian et al. | 451/359 |
| 8,449,356 | B1 | * | 5/2013 | Sae-Lee | 451/450 |
| 2002/0066148 | A1 | | 6/2002 | Castellon | |
| 2002/0109308 | A1 | | 8/2002 | Ochoa | |
| 2005/0095863 | A1 | * | 5/2005 | Tran | H01L 21/31053 438/692 |
| 2005/0227599 | A1 | * | 10/2005 | Fisher | 451/526 |
| 2006/0079163 | A1 | * | 4/2006 | Montabaur | 451/542 |
| 2008/0155904 | A1 | * | 7/2008 | Peterson | B24B 1/00 51/308 |
| 2008/0201877 | A1 | | 8/2008 | Sengewald et al. | |
| 2010/0062688 | A1 | | 3/2010 | Thysell et al. | |
| 2010/0109684 | A1 | * | 5/2010 | Koblasz | A61F 5/48 324/694 |
| 2011/0250827 | A1 | * | 10/2011 | Smith et al. | 451/449 |

FOREIGN PATENT DOCUMENTS

| | | | |
|---|---|---|---|
| JP | 2001012024 | A * | 1/2001 |
| NZ | 561330 | | 6/2009 |
| WO | WO 2005/037486 | | 4/2005 |

OTHER PUBLICATIONS

Scotch-Brite clean and Strip XT Disc Examination reference (Annexed) http://solutions.3m.com/wps/portal/3M/en_US/Manufacturing/Industry/Product-Catalog/Online-Catalog/?PC 7 RJH9U-5230GE3E02LECFTDQGLE0000000nid=036H3XVM54gsH55C-PWS904gITBD213STQ7bl.

* cited by examiner

ABRASIVE APPARATUS AND COMPONENTS THEREOF

FIELD OF THE INVENTION

This invention relates to improvements in respect of abrasive apparatus and components thereof. In particular the present invention may provide a powered device used as a sanding machine or similar to apply and move an abrasive component or material on a surface. Also within the scope of the invention is a removable abrasive head which may in some embodiments be employed with the abrasive apparatus referenced in respect of this invention, or may alternatively be used with existing prior art sanding machinery.

The invention has particular applicability in applications where large surface areas are to be sanded and preferably where the dispersal of sanding dust is to be controlled while minimising heat build up in the surface being worked.

BACKGROUND OF THE INVENTION

Powered sander or abrasive machines are well known forms of technology which are normally configured for use in bench top applications. These types of machines are usually electrically powered with a battery or a power line connection and operate by rotating belts or sheets of abrasive material placed in contact with a surface to be abraded.

These existing powered sanders are effective for small jobs and are generally used in carpentry applications where small surface areas are to be sanded and there is a convenient supply of electrical energy available.

Existing powered sanding machinery cannot be used effectively when large areas are to be sanded as they lack the power to quickly abrade surfaces. Aside from power requirements, the abrasive paper or heads employed will rapidly become clogged with sanding dust which substantially degrades the effectiveness of the machine and the quality of the sanding finish. Furthermore, heat build up is an issue where the frictional heat generated can potentially damage or degrade the surface being sanded. Existing powered sanders are normally hand held with the hands of the user close to the working abrasive head, requiring a user to position themselves close to the surface being sanded and the sanding dust generated. Electrical sanding machines can only be used outside when it is not raining. The presence of water in conjunction with electrical equipment is unsafe and could lead to dangerous electrical shocks being delivered to the user.

Large surface areas need to be sanded in house painting applications, particularly where weather boards are to be re-painted. Such existing prior art powered sanders are ineffective in these applications for the reasons specified above—notwithstanding that a ready supply of electrical energy may not necessarily be available at the exterior of the house. The house exterior must normally be water blasted clean first, then sanded to a smooth finish prior to a fresh coat of paint being applied. Water blasting still does not remove all greasy film residues which, when traditional sanding methods are used, will still clog the abrasive paper, although not as much had the surface not been water blasted.

As it would be appreciated by those skilled in the art, this is a slow multi-stage process which can consume a significant amount of sandpaper and generate high volumes of sanding dust. In the case of weatherboard clad houses care needs to be taken to ensure the overhanging underside of each weatherboard is sanded properly in addition to the main outward face of each board. The presence of these two separate weatherboard surfaces can require each to be sanded as a separation action and by hand.

The generation of sanding dust is also a health and safety issue. In the case of older structures, lead based paint may have been employed and later sanding can release lead containing particles into the atmosphere.

A further issue involved with paint preparation, and in particular in respect of sanding acrylic paints, is the formation of heat blisters in underlying paint layers. In some instances sanding work may provide an appropriate finish for painting without necessarily indicating that friction heat has promoted delaminating or the formation of a blister under the old paint—where these blisters become obvious some time later. The surface may be completely prepared for repainting only to have heat blisters form subsequently, ruining the preparation work or potentially a fresh coat of paint. These blisters can form two, three or even more days after sanding, allowing a more than enough time for the completion of painting work which would need to be repeated.

A number of the same issues are also experienced in marine maintenance applications and in particular with the reapplication of anti-fouling coatings on the hulls of vessels. In such applications, the existing anti-fouling on a hull must be sanded back which can generate high volumes of relatively toxic sanding dust.

It would therefore be of advantage to have an improved abrasive apparatus and components which could potentially be used with this apparatus which addressed any or all of the above issues. In particular, a sanding apparatus which could work quickly and effectively to abrade large surface areas while controlling the release of the sanding dust generated would be of advantage. A sanding or abrasive apparatus which operated to reduce the chances of sanding paper clogging with sanding dust or heating up through the friction generated by sanding would also be of advantage. Furthermore an abrasive apparatus with a portable nature which does not rely on an electrical energy supply would also be of advantage.

Existing sanding machines use disposable abrasive head mounted materials formed from sheets or belts of fabric or paper. These heads can only be maneuvered into a limited number of orientations or positions with respect to the surface being sanded depending on the dimensions of the drive machine they are mounted to. Potentially a range of different sanding machines with various forms of working heads may be required to completely sand the corners or under hanging surfaces of an area—such as the case with the sanding preparation required for repainting weatherboards.

These sanding heads are also limited in their ability to work in wet environments and can fail quickly when exposed to water.

Other existing sanding machines incorporate a quick change configuration system for sandpaper sheets using hook and pile style fasteners commonly known as Velcro™. Although these systems do allow sandpaper to be changed quickly, in general the fastening system employed is susceptible to damage by use of the sander, and potentially can be weakened and fail prior to the consumption of the sandpaper itself. Furthermore, these existing sanding machine abrasives cannot operate in wet conditions and will quickly become weakened and fail once moist.

It would therefore be of advantage to have an abrasive material head for a sanding machine or apparatus which could address any or all of the above problems, or at least provide the public with an alternative choice.

DISCLOSURE OF THE INVENTION

According to one aspect of the present invention, there is provided an abrasive apparatus that includes a drive shaft terminating with a working head, said working head being configured to removably attach to an abrasive attachment, and a drive system arranged to rotate the drive shaft, the drive system being connected to the drive shaft distal from the working head, and at least one fluid supply conduit having an inlet and at least one outlet, said at least one outlet being located adjacent to the working head of the drive shaft and arranged to deliver fluid to the abrasive attachment and/or immediate working area.

According to an additional aspect of the present invention, there is provided an abrasive apparatus that includes a drive shaft terminating a working head, and a drive system arranged to rotate the drive shaft, the drive system being connected to the drive shaft distal from the working head, and an abrasive attachment removably attached to the working head of the drive shaft, and at least one fluid supply conduit having an inlet and at least one outlet, said at least one outlet being located adjacent to the working head of the drive shaft and arranged to deliver fluid to the abrasive attachment.

According to a further aspect of the present invention, there is provided an abrasive apparatus substantially as described above wherein the drive system is formed by a high power high drive system which incorporates or includes an internal combustion engine.

According to yet another aspect of the present invention there is provided an abrasive apparatus as substantially described above, wherein a high power drive system is capable of rotating the working head of the drive shaft at between 2500 and 12000 revolutions per minute (rpm).

According to yet another aspect of the present invention there is provided an abrasive apparatus as substantially described above, wherein a high power drive system is capable of rotating the working head of the drive shaft at approximately 11,000 revolutions per minute (rpm).

According to a further aspect of the present invention, there is provided an abrasive apparatus as substantially as described above wherein an inlet of a fluid supply conduit is connected to a water supply.

According to another aspect of the invention there is provided an abrasive attachment configured to be removably attached to an abrasive apparatus which includes a drive shaft adapted to rotate the attachment, the attachment including a mounting plate, and at least one working surface incorporating one or more abrasive components, wherein one side of a working surface is permanently adhered to a surface of the mounting plate using a waterproof adhesive.

According to yet another aspect of the present invention, there is provided an abrasive attachment configured to be removably attached to an abrasive apparatus, the attachment including a flat working surface and an annular working surface positioned adjacent to and at an angle to one another, each working surface incorporating abrasive particles bonded to a waterproof backing.

According to a further aspect of the present invention, there is provided an abrasive attachment substantially as described above wherein a waterproof adhesive is used to bond the abrasive particles to the waterproof backing.

According to a further aspect of the present invention there is provided an abrasive attachment substantially as described above wherein the flat and annular working surfaces are orientated substantially perpendicular to one another.

According to a further aspect of the present invention, there is provided an abrasive attachment substantially as described above which also includes a mounting plate where the flat working surface is applied to an exterior face of said mounting plate and the annular working surface applied to the rim of the mounting plate.

According to yet another aspect of the present invention there is provided an abrasive attachment configured to be removably attached to an abrasive apparatus, the attachment including a flat working surface incorporating abrasive fibres bonded to a waterproof backing.

According to a yet further aspect of the present invention, there is provided an abrasive attachment configured to be removably attached to an abrasive apparatus, the attachment including a pair of flat working surfaces orientated substantially parallel to one another and located on opposites sides of a mounting plate, each working surface incorporating abrasive particles bonded to a waterproof backing.

The present invention is adapted to provide improvements in relation to abrasive apparatuses and attachments to be used with such abrasive devices.

The present invention incorporates both improvements in respect of the abrasive devices themselves in addition to abrasive attachments which may in some instances—but not all cases—be used with the improved apparatus discussed below. The invention therefore incorporates within its scope improvements to abrasive attachments which may be utilised by a range of different abrasive devices An abrasive attachment provided in conjunction with the present invention is adapted to engage with a drive shaft of an abrasive apparatus which in turn in use is operated to rotate the attachment. An abrasive attachment provided by the invention is configured to be removably attached to a drive shaft, thereby allowing these attachments to be replaced once they have reached the end of their useful lives.

An abrasive attachment provided by the invention is configured to operate in wet environments without suffering damage or a degradation in performance. This characteristic of the invention is achieved by one side of a working surface of the attachment being permanently adhered to a surface of the mounting plate using a waterproof adhesive. This arrangement provided a strong, fixed and permanent waterproof connection between these components.

In one aspect of the invention an abrasive attachment includes a flat working surface and also an annular working surface positioned adjacent to and at an angle to one another. These two angled adjacent working surfaces allow the attachment to be used to abrade or otherwise sand two adjacent surfaces at the same time. Alternatively, either the annular or flat working surfaces may be applied to various surfaces requiring sanding depending on the configuration and access available to such surfaces.

In a preferred embodiment the flat and annular working surfaces may be orientated substantially perpendicular to one another. This arrangement of working surfaces has been found to be particularly advantageous when the weatherboard cladding of buildings is to be sanded. This arrangement allows the flat working surface to abrade or otherwise sand the exterior face of the weatherboard while at the same time the annular working surface abrades the exposed underside of the weatherboard directly above the attachment. In this role the abrasive attachment can be used to effectively sand all the exposed surfaces present in weatherboards in one single pass.

An abrasive attachment provided by the invention includes at least one working surface incorporating one or more abrasive components. An abrasive component as used in conjunction with the invention may be provided by any material or structure which can have an abrasive effect on a surface when moved against this surface.

For example in one potential embodiment an abrasive attachment may be provided which includes an abrasive component formed by a cutting blade incorporating a plurality of teeth. This cutting blade may be permanently connected to a face of a waterproof mounting plate using waterproof glue.

In some implementations of this embodiment the central hub of the blade may form and indented cup or puck type element which projects into the interior of volume of the mounting plate. This indented puck can be engaged directly with a drive shaft of an abrasive apparatus to safely secure the abrasive blade during use. The indented puck or cup formed in the centre of this blade can be arranged to receive a locking nut or similar component which holds these two components together.

In a further preferred embodiment each tooth of the cutting blade is set at the same direction and angle to the body of the cutting blade. This form of abrasive component can be particularly useful when multiple layers of paint need to be removed from a surface.

In yet another embodiment each working surface may incorporate abrasive components in the form of abrasive particles bonded to a waterproof backing. A wide variety of grit sizes and densities may be employed to form such a working surface, with grit ratings of approximately 16 or higher capable of being used in conjunction with the invention.

In a further preferred embodiment the bonding used to apply these abrasive particles may also be formed from a waterproof adhesive. This arrangement of a working surface allows it to be used in wet conditions and preferably also in combination with the abrasive apparatus discussed further below. In particular, an attachment provided by the invention in such embodiments can include a waterproof mounting plate connected to a working surface by a waterproof adhesive, where this working surface is formed by a waterproof backing connected to an abrasive material by a further layer of waterproof adhesive.

Those skilled in the art will appreciate that the waterproof backing material used will vary in different embodiments. For example, in some embodiments this backing material may be formed from fabric or fibre basked materials, or alternatively waterproofed papers or cards.

In accordance with yet another embodiment an abrasive attachment may include abrasive components formed from abrasive fibres bonded to a waterproof backing. These abrasive fibres may be used in applications where abrasive particles are too coarse and more of a polishing effect is required of the invention.

For example, in such instances fibres such as steel wool or scouring pad materials such as Scotchbrite™ may be used with an abrasive attachment. These materials may be permanently adhered to a waterproof backing within a similar abrasive attachment as discussed for use above with abrasive particles.

The abrasive attachment also includes a mounting plate with a flat working surface applied to the exterior face of the plate. In some embodiments an annular working surface may also be applied to the rim of the mounting plate. The mounting plate therefore forms a support to which the backing and abrasive materials of each of the working surface are applied and a structure which allows for a firm and reliable connection to be made to the drive shaft of an abrasive apparatus.

In a preferred embodiment a mounting plate may be provided with a thickness of at least 20 mm. This thickness of mounting plate provides enough clearance within the central interior of the plate to receive and locate the end of an abrasive apparatuses driveshaft and a locking system used to connect the abrasive attachment to this driveshaft.

In a number of embodiments the width or diameter of this mounting plate may vary with the application in which the invention is used. For example in some embodiments a mounting plate may be provided with a diameter of approximately 100 mm, whereas in other embodiments a mounting plate may be provided with a diameter of 200 mm. Those skilled in the art will appreciate that a variety of different mounting plate diameters may be employed in conjunction invention depending on the application which the invention is used and the power or capacity of the abrasive apparatus with which such the attachment is used.

In a further preferred embodiment the mounting plate used may be formed from a soft polyethylene pad. This material is waterproof, relatively strong and also inexpensive and therefore provides a useful mounting system for a disposable abrasive attachment. However those skilled in the art will appreciate alternative types of materials may also be used to form mounting plates in conjunction with the present invention. In particular, a variety of similar waterproof polymers or resilient foams may be used in alternative embodiments.

In some embodiments of the invention an abrasive attachment may also include at least one strengthening plate. This additional strengthening plate may be provided to give additional strength or rigidity to a mounting plate, preventing or reducing the chances of the mounting plate flexing when the attachment is used. For example, in such embodiments a strengthening plate may be disposed between the mounting plate and the mounting plate connection to the drive shaft of an abrasive apparatus.

Those skilled in the art will appreciate that the diameter of such a strengthening plate can vary in a number of different embodiments. For example in some cases a relatively small strengthening plate may be provided to only slightly overlap a hollowed out area provided within a mounting plate for driveshaft connection purposes. Conversely in other embodiments a strengthening plate may extend almost to the perimeter of a mounting plate.

In a further embodiment a strengthening plate may be directly adhered or otherwise connected to a mounting plate, with the strengthening plate being used to connect the abrasive attachment to the drive shaft of an abrasive apparatus.

In some embodiments the present invention may incorporate a pair of working surfaces orientated substantially parallel to one another. In such embodiments the abrasive employed on each working surface may face in opposite directions. This allows a fresh working surface to be deployed once the opposite is exhausted simply by reversing the orientation of the abrasive attachment.

The backing of each working surface is directly and permanently adhered to the corresponding surface of the mounting plate. This permanent direct adhesion ensures that the connection between the mounting plate and the working surfaces does not fail easily or slowly over repeated use of the attachment. Preferably one side of a working surface is permanently adhered to a surface of the mounting plate using a waterproof adhesive.

As indicated above, the present invention also incorporates within its scope an improved abrasive apparatus which in preferred embodiments may be removably connected to an abrasive attachment substantially as discussed above.

An abrasive apparatus provided in accordance with the present invention incorporates a drive shaft connected to a drive system, with the opposite end of the drive shaft having a working head connected to an abrasive attachment. Also located adjacent to the working head is at least one outlet of a fluid supply conduit arranged to deliver fluid to the abrasive attachment.

Those skilled in the art should however appreciate that this improved abrasive apparatus may be utilised with a range of different forms of abrasive attachments. In particular, this apparatus may use any form of abrasive attachment which may be readily connected to the working head of the drive shaft and which incorporates at least one working surface with abrasive compounds bonded to a waterproof backing material.

Those skilled in the art will also appreciate that a range of abrasive components may also be used with the invention. In particular, sand papers adapted for use in wet environments may be employed in a large number of applications considered for the invention.

In other instances less harsh polishing materials such as for example polishing fibre compounds such as steel wool or Scotchbrite™ may be used in place of the sand paper based abrasive particles. These types of polishing materials can be used in applications other than sanding, such as for example, for the removal of graffiti from metal road signs and from other surfaces which potentially may experience significant damage if exposed to rotating abrasive particles. In yet other embodiments an abrasive component may be provided by a saw blade with a plurality of teeth, utilised in embodiments where many layers of paint are to be removed from a surface.

It should be appreciated that a wide range and number of different forms of abrasives and existing abrasive products may be used in conjunction with the invention. For example, the invention may use any permutation of combination of the following in various embodiments:

- Abranet
- Carborundum
- Garnet
- Aluminium oxide
- Carbon oxide
- Silicon carbide
- Zinc-strearate
- Aluminate oxide zirconia utectic
- Scotchbrite and/or other similar forms of abrasive fiber polishing focused materials
- Non-woven nylon disc products sprayed with abrasives such as Clean & Strip™ by 3M
- Concrete grinding discs
- Sand screens or abrasive mesh screens As discussed further below, the delivery of a fluid, and preferably water, on to the abrasive by the invention substantially increases the working lifespan of such abrasive materials. Furthermore the use of a waterproof adhesive, and where appropriate, the waterproof backing material within the abrasive attachment in preferred embodiments allows a wide range of abrasives to be used with the invention.

Reference in general however will be made to the abrasive apparatus provided also using or incorporating the abrasive attachment discussed above. Those skilled in the art should appreciate that a combination of these two aspects of the invention should in no way be seen as limiting.

In a preferred embodiment the invention may incorporate a high powered drive system capable of rotating the working head at high speed. This configuration of the abrasive apparatus allows it to perform efficiently in applications where large surface areas are to be abraded or sanded, with the high power output of the drive system ensuring that surfaces may be both quickly and effectively sanded.

In a further preferred embodiment the drive system may incorporate or include an internal combustion engine. Internal combustion engines are extremely well known and can be provided at relatively low costs—particularly in respect of smaller engines with relatively low power outputs relative to the entire range of power outputs provided by this class of engine.

In a preferred embodiment the drive system of the apparatus may be provided by the same drive system as a weed and grass trimmer having a rotary cutter driven by a drive shaft. These weed and grass trimming devices are generally known as line or string trimmers due to the use of a cutting line rotated by the drives system. A similar style of device using a fixed metal blade is known as a brush cutter. Existing line trimmers or brush cutters can employ small internal combustion engines to rotate the cutting line or head at sufficient speed to perform effectively trimming grass and weeds. This pre-existing form of drive engine can therefore be adapted for use in conjunction with the present invention.

In a further preferred embodiment, the extended drive shaft arrangement of a brush cutter or line trimmer may also be utilised as the drive shaft required for the present invention. This arrangement of the abrasive apparatus extends the working head of the working head well away from the hands and face of a user and provides a configuration which may not require the user to bend down or bend over when using the apparatus. Furthermore, by displacing the working head well away from the operator's hand and body this in turn limits the operator's exposure to any fluid spray generated by use of the apparatus as discussed further below.

In a preferred embodiment the drive system employed may be formed from a petrol powered engine with a capacity ranging from 21 cubic centimeters (cc) to 65 cubic centimeters (cc). The Applicant have found that the power delivered by these sizes of petrol engines is entirely sufficient for the abrasion and sanding based applications envisioned for the present invention,—while still allowing the invention to provide significant advantages in applications where large surface areas are to be sanded effectively and quickly and by using much larger disc than are currently available.

Reference in general throughout the specification will also be made to the present invention incorporating a 45 cc petrol engine drive system. However, those skilled in the art should consider that other alternative forms of drive systems may also be employed in conjunction with the present invention and reference to petrol engines of this form should in no way be seen as limiting. A drive system capable of driving or rotating the inventions working head variably between 2,500 and 12,000 rpm may be used with the invention in various embodiments.

For example, in one alternative embodiment an appropriately sealed and ruggedized electric motor of a power or capacity required by the invention may be employed. In such embodiments this electric motor may also be connected to a battery based power system which again can be sealed and protected against environmental water exposure.

An abrasive apparatus provided by the invention also include at least one fluid supply conduit. Such a conduit has one or more outlets which are located adjacent to the working head of the drive shaft, with an outlet arranged to deliver fluid to the abrasive attachment and immediate working area when the apparatus is used.

Reference in general will also be made to the present invention incorporating a single fluid supply conduit with a single inlet and a single outlet. However, those skilled in the art should appreciate that a plurality of conduits may be provided in other applications as can conduits which form a manifold with a number of outlets and potentially a number of inlets. Those skilled in the art should appreciate that the exact form and arrangement of a fluid supply conduit employed with the present invention may vary in a number of different applications.

Preferably an inlet of a fluid supply conduit may be connected to a water supply. Water can perform effectively in conjunction with the invention as a coolant in addition to a lubricant which removes the built up sanding residue from the abrasive attachment. Water can be supplied directly onto an abrasive attachment and immediate working area when rotated by the drive system which will immediately cool the surface being sanded or abraded, to keep the working surfaces of the abrasive attachment clear of dust build up and to also reduce the chances of sanding dust forming in the air around the abrasive apparatus. Furthermore the watery residue generated can be easily collected and then disposed of if a mesh drop sheet is used on the ground below the working area.

In one embodiment an inlet of the fluid supply conduit may incorporate a garden hose connector allowing the inlet to be engaged directly with water supplied under pressure by a water utility.

However, in other embodiments the inlet of a fluid supply conduit may be arranged to connect to a portable reservoir or tank of water which may be transported to the location in which the apparatus is to be used. In such embodiments the water supply tank employed may be elevated above the area where the apparatus is to be used to pressurise the water supplied to the fluid supply conduit. Alternatively, a pump may be employed to pressurise water from this form of tank supply and to deliver same to the inlet of a fluid supply conduit.

Reference in general will also be made to the fluid supply conduit being employed to deliver water to an abrasive attachment. Those skilled in the art will however appreciate that other fluid compounds may be used in conjunction with the present invention instead of water. For example, in some embodiment steam may be delivered to assist in removing sanding or otherwise abrading materials from the surface, or in other instances active chemical agents may also be dispensed by a fluid supply conduit.

Those skilled in the art should also appreciate that the abrasive apparatus provided may also be used after a pre-treatment process has been applied to a surface to be sanded or abraded. For example, in some instances paint stripping compound may be applied to a surface as a preliminary step prior to the use of the present invention. Such pre-treatment processes can again shorten the time period required to effectively sand a large surface area with the use of the invention.

Preferably, an outlet of the fluid supply conduit may be located adjacent to the working head of the drive shaft by being directly fixed to the working head by an offset projection. This projection may orientate or position the outlet to ensure a stream of water it supplies is directed onto the abrasive attachment and/or the immediate working area. Furthermore, in some embodiments the connection between the working head and outlet may be adjustable or rotatable to allow the angle at which fluid is delivered to be adjusted.

The present invention may provide many potential advantages over the prior art abrasive attachments and existing abrasive apparatus.

An improved abrasive attachment provided by the present invention allows two adjacent surfaces to be worked at the same time, or different arrangements of surfaces to be accessed by the same attachment. In preferred arrangements significant time savings can be seen in respect of the preparation of weatherboard clad structures for repainting. Potentially a single pass of the abrasive attachment can sand all the exposed surfaces of weatherboards.

An abrasive apparatus provided by the invention can perform effectively to sand or abrade large surface areas relatively quickly compared with prior art systems. This apparatus may be used in a range of applications from sanding or preparation for repainting, the removal of anti-fouling in again the preparation for repainting in marine applications, through to any other applications requiring the sanding or abrading any size surface areas, and in particular large areas.

The fluid supply conduit of such an apparatus can be utilised to minimise the generation of sanding dust free in the air around the apparatus in addition to minimising heat build up in the surface being worked and the potential for damage to the surface. The supply of fluid (and in particular water) also keeps the abrasive used clear of clots—allowing for continuous high speed use of the invention while prolonging the life of the abrasive.

An abrasive apparatus provided by the invention may be constructed using existing components and systems generally drawn from grass and shrub cutting line trimmer devices, providing an apparatus that can be constructed at relatively low cost. Furthermore, these existing line trimmer arrangements can also be utilised in conjunction with the invention to extend the working head from a set of handles employed by a user to improve its ergonomics of use and safety characteristics.

BRIEF DESCRIPTION OF THE DRAWINGS

Additional and further aspects of the present invention will be apparent to the reader from the following description of embodiments, given in by way of example only, with reference to the accompanying drawings in which.

Further aspects of the invention will become apparent from the following description of the invention which is given by way of example only of particular embodiments.

BEST MODES FOR CARRYING OUT THE INVENTION

Figure 1:
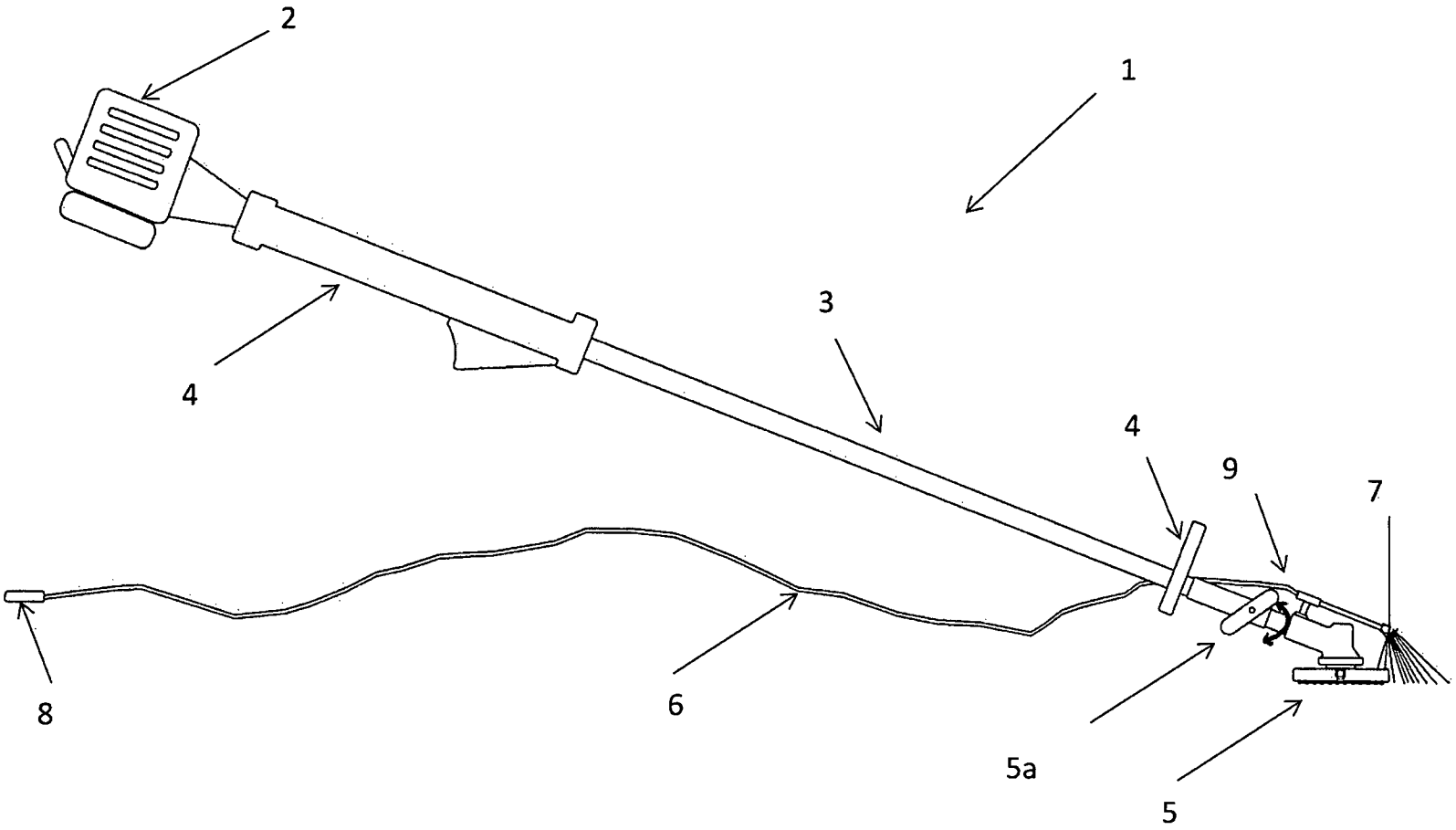
FIG. 1 shows a side view of an abrasive apparatus as provided in accordance with a preferred embodiment of the invention.

FIG. 1 shows a side view of an abrasive apparatus as provided in accordance with a preferred embodiment of the invention.

The apparatus 1 incorporates a drive system, shown in this embodiment as a 45 cc petrol engine 2 linked to an extended internal drive shaft 3 with a set of handles 4 extending to the sides of the drive shaft. The drive shaft 3 terminates in a working head 5 where this working head is arranged to receive and connect to an abrasive attachment as discussed with respect to FIGS. 2 through 6. The working head 5 is engaged to the end of the internal drive shaft by a rotatable gear box coupling 5*a*. This coupling allows the orientation of the working head to be adjusted relative to the shaft by 90 degree intervals.

When the apparatus is used to abrade or sand a surface the petrol engine 2 is adapted to rotate portions of the drive shaft 3 to rotate an abrasive attachment associated with the working head 5.

When the apparatus is used a fluid supply conduit 6 is employed to deliver fluid from its outlet nozzle 7 located adjacent to and (in this embodiment) directly on the working head. Fluid from the outlet of the conduit 6 is directed in a stream by the nozzle 7 on to the abrasive attachment to mitigate the build up of heat in the surface being sanded, to minimise the generation of air borne sanding particles and to also minimise the clogging of the abrasive employed in the abrasive attachment.

An offset projection 9 is used to position the outlet nozzle 7 and direct the flow of fluid. The end of this projection 9 distal from the working head can be rotated relative to the working head. This allows for the adjustment of the angle at which fluid flows from the conduit relative to the working head.

An inlet 8 of the conduit incorporates a standard garden hose fitting, allowing the conduit to be connected directly to a water utility supply. In the embodiment shown pressurised water from the water utility is delivered directly to the outlet of the conduit—with the flow rate of water being determined by a tap position associated with the connection to the water supply.

Figure 2:
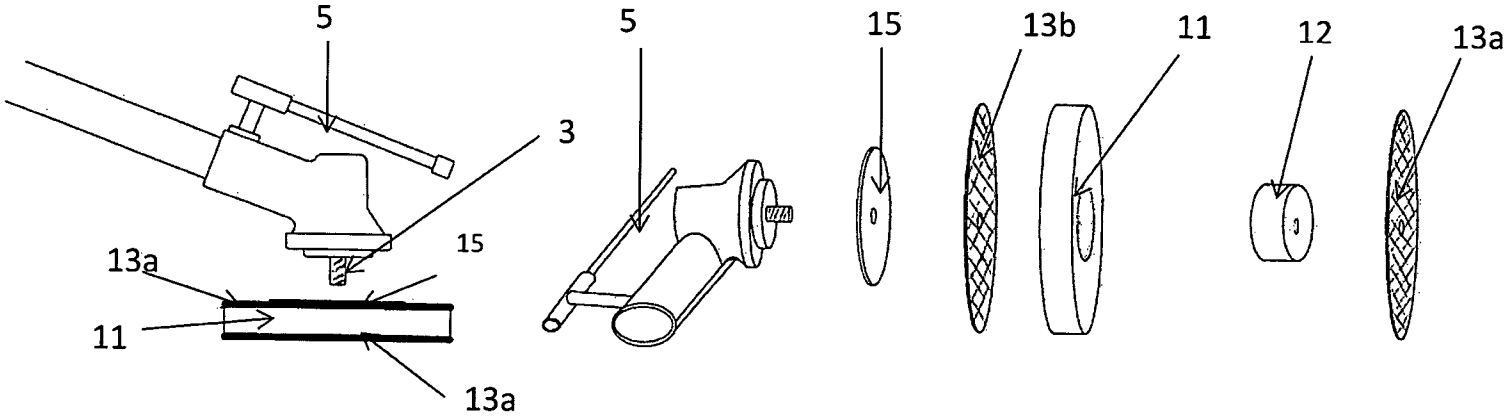
FIG. 2 shows an enlarged and exploded view of the abrasive attachment and working head of the embodiment illustrated with respect to FIG. 1.

FIG. 2 shows an enlarged and exploded view of the abrasive attachment and working head 5 of the embodiment illustrated with respect to FIG. 1.

In the embodiment shown the abrasive attachment is formed by a mounting plate 11, provided in this embodiment by a waterproof polyethylene pad. The mounting plate 11 includes a central cavity arranged to receive a complimentary locking nut assembly 12. This locking nut assembly is glued inside the cavity formed in the mounting plate and includes a threaded aperture in its center, allowing the end of a drive shaft to be screwed on to the attachment and locked in place.

Both flat sides of the mounting plate are engaged with a flat working surface 13*a*, 13*b* by a waterproof adhesive. Each flat working surface is formed by a waterproof backing fabric which has abrasive particles applied to one side, again using a waterproof adhesive. This arrangement of the working surface material allows the attachment to be employed within streams of water A further strengthening plate 15 is provided which in use is situated between the working head 5 and the inner working surface 13*b*. The strengthening plate 15 gives the abrasive attachment additional rigidity, resisting deformation of the attachment during use. The strengthening plate 15 also impedes flexing of the mounting plate and damaging the adhesive connection of the locking nut assembly 12 to the mounting plate 11.

In the embodiment shown each of the pair of flat working surfaces 13*a*, 13*b* are applied to the parallel flat faces of a mounting plate 11. Once the starting working surface 13*a* is eroded enough by use that its performance beings to drop, the attachment can simply be detached, flipped over and then re-attached to present the second working surface 13*b* to a material to be abraded.

Figure 3:
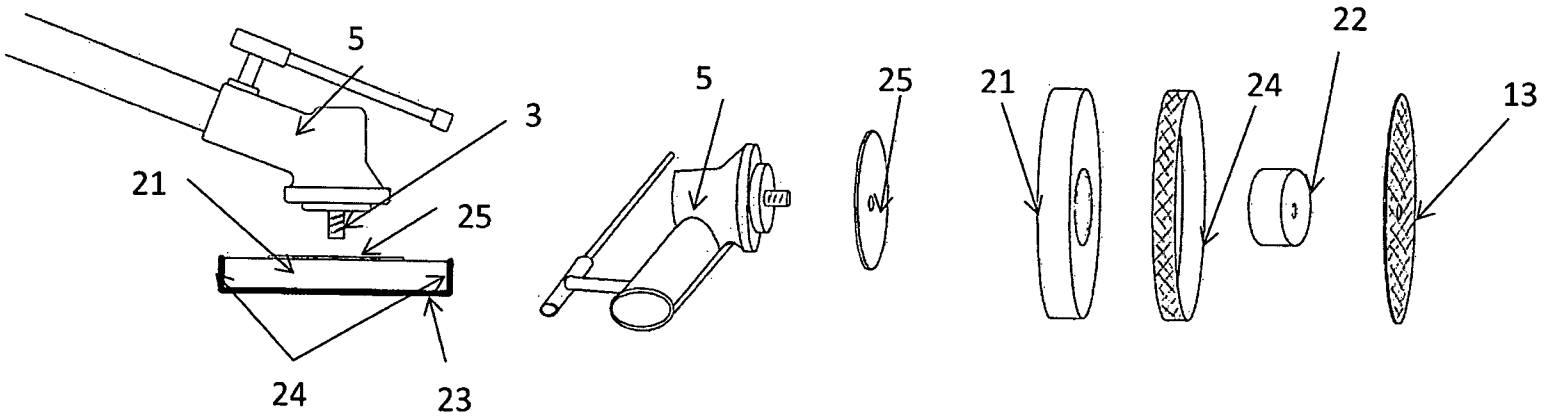
FIG. 3 shows an enlarged and exploded view of an abrasive attachment and working head employed in an alternative embodiment to that illustrated with respect to FIG. 1.

FIG. 3 shows an enlarged exploded view of an alternative abrasive attachment to the embodiment illustrated with respect to FIGS. 1 and 2.

This abrasive attachment includes two working surfaces, being a flat working surface 23 and an annular working surface 24. These two working surfaces are permanently bonded to a mounting plate 21 with the annular working surface located on the rim of the plate and the flat working surface located on the exterior face of the plate 21. An intermediate strengthening plate 25 is disposed between these components when assembled and the main body of the working head 5.

The mounting plate is formed to create a 22 mm round lip which centralises the positioning of a complimentary locking nut assembly 22. The interior of this lip receives the locking nut and the end of a drive shaft 3 of the working head 5. In other embodiments a 10 mm round lip may be formed.

Again the locking nut assembly 22 is glued inside the cavity formed in the mounting plate and includes a threaded aperture in its center, allowing the end of a drive shaft 3 to be screwed on to the attachment and locked in place. Again the strengthening plate 25 also impedes flexing of the mounting plate and damaging the adhesive connection of the locking nut assembly 22 to the mounting plate 21.

As can be seen from this figure both these working surfaces 23, 24 are orientated substantially perpendicular to one another, allowing the attachment when rotated to abrade two separate surfaces which sit substantially at right angles to one another. This arrangement of the attachment provides significant advantages in respect of the preparation of weatherboard clad structures for repainting.

Each working surface has abrasive particles bonded to a backing material. This backing material is formed from waterproof card or fibre with a waterproof bonding material used to apply the abrasive particles to this backing. This arrangement of the working surface material again allows the attachment to be employed within streams of water.

In other embodiments polishing materials such as Scotchbrite™ can be used in place of the abrasive particles shown. These types of polishing materials can be used in applications other than sanding, such as for example, for the removal of graffiti from metal road signs and from other surfaces which potentially may experience significant damage if exposed to rotating abrasive particles.

Figure 4:
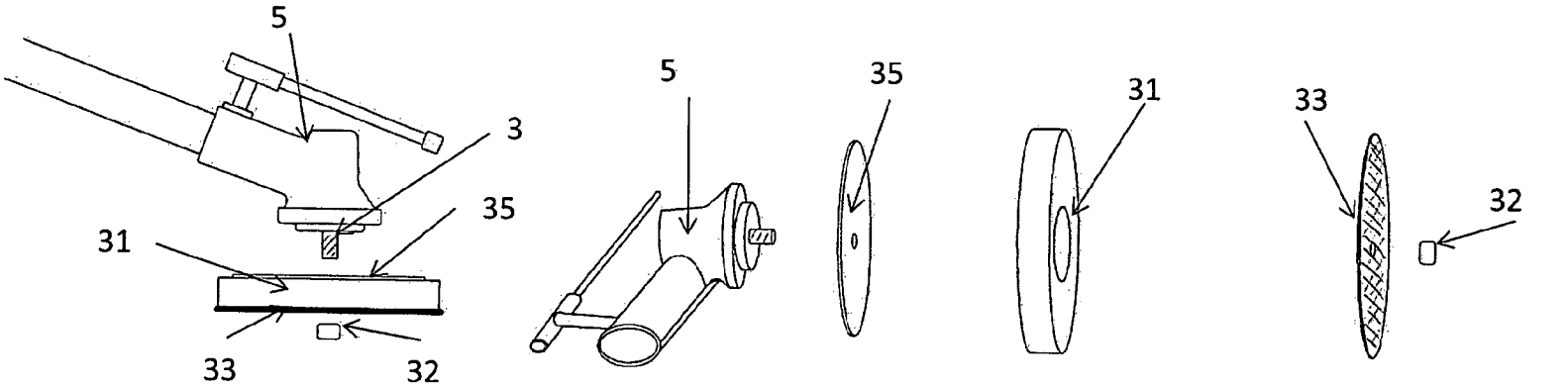
FIG. 4 shows an enlarged and exploded view of an abrasive attachment and working head employed in an alternative embodiment to the embodiments illustrated with respect to FIGS. 1 through 3.
Figure 5:
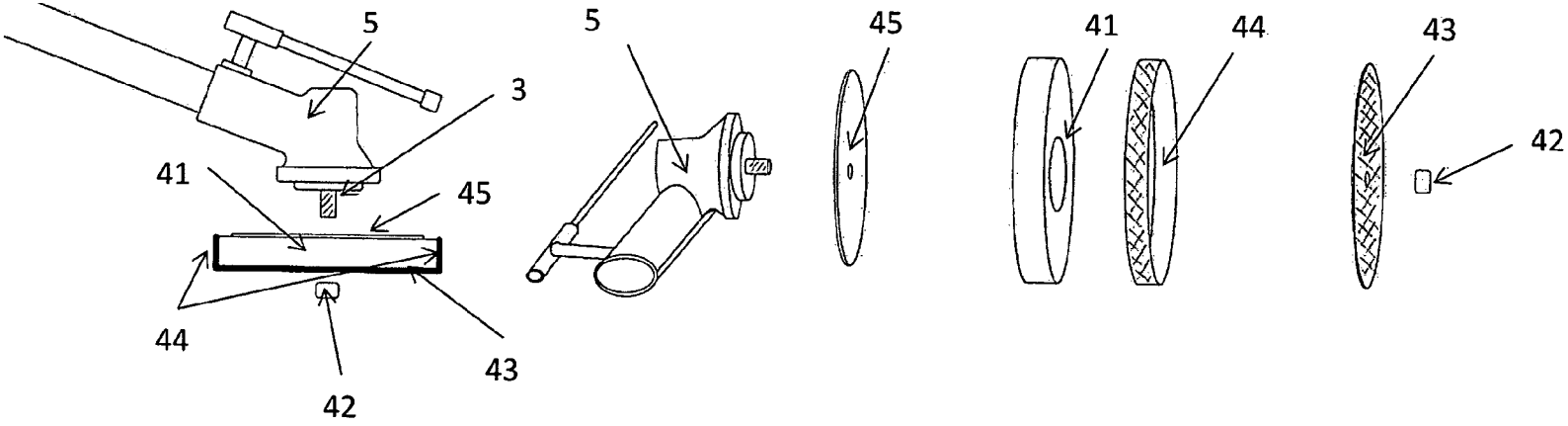
FIG. 5 shows an enlarged and exploded view of an abrasive attachment and working head employed in an alternative embodiment to the embodiments illustrated with respect to FIGS. 1 through 4.

FIGS. 4 and 5 show yet further alternative implementations of an abrasive apparatus.

In the embodiment shown with respect to FIG. 4 the attachment includes a single flat working surface 33, a strengthening plate 35 and a central mounting plate 31. All these components are held on the end of a working head 5 drive shaft 3 by a locking nut 32.

In the embodiment shown with respect to FIG. 5 the attachment includes a single flat working surface 43 in addition to an annual working surface 44, a strengthening plate 45 and a central mounting plate 41. All these components are again held on the end of a working head 5 drive shaft 3 by a locking nut 42.

In both the embodiments shown in respect of FIGS. 4 and 5 the strengthening plate 35, 45 extends over the majority of one side of the mounting plate 31, 41. The mounting plate includes a central cavity which receives the threaded end of a drive shaft, where the locking nut 32, 42 locks the end of the drive shaft 3 against the strengthening plate 31, 41.

Figure 6:
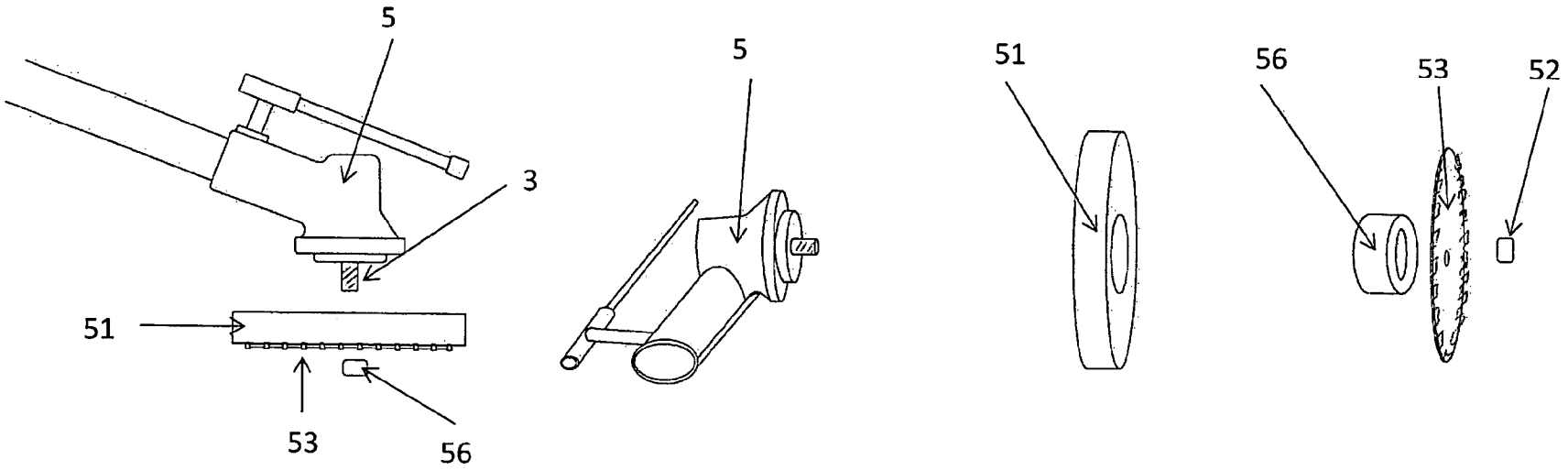
FIG. 6 shows an enlarged and exploded view of an abrasive attachment a working head employed in an alternative embodiment to the embodiments illustrated with respect to FIGS. 1 through 5.

FIG. 6 show an abrasive attachment implemented in accordance with a further embodiment which employs a saw blade as an abrasive component.

In the embodiment shown in FIG. 6 an abrasive attachment is provided with an abrasive component formed by a circular saw blade 53. Each of the teeth of this blade is set at the same angle and in the same upward direction from a mounting plate which the blade is engaged with. By setting all the teeth of the abrasive blade at the same angle and in the same direction this ensures that these teeth all project outwards slightly from the main body of the blade and contact the surface to be abraded. These teeth will therefore remove multiple layers of old paint from a surface in the circular track they travel through when rotated by an associated abrasive apparatus.

The underside of the blade 53 and upper face of a mounting plate 51 are engage together with a waterproof adhesive. The mounting plate 51 includes a hollow central cavity arranged to receive a locating cup 56. This locating cup 56 has a circular side wall and a floor (not shown) which defines an aperture sized to allow the passage of the end of the drive shaft 3. The cup is formed from a metal element welded to the underside of the blade, where the floor of the cup provides a bearing surface used to lock the end of the drive shaft 3 in place with a locking nut 52. To attach the end of the drive shaft to the attachment it is moved into the locating cup, with the locking nut then moved through an aperture formed in the blade into the cup. The locking nut is then threaded over the end of the drive shaft and tightened to lock the end of the drive shaft against the floor of the cup.

FIG. 6 shows the form of the mounting plate 51 used, which is provided in this embodiment by a cylindrical foam rubber pad. This pad plays an important role in the operation of the invention in this embodiment, acting to control the orientation of the blade and as a levelling element when placed in contact with a flat surface. As this foam pad has a diameter or extent greater than the diameter of the blade it will act as a levelling element when placed in contact with any flat surface to be abraded.

In the preceding description and the following claims the word "comprise" or equivalent variations thereof is used in an inclusive sense to specify the presence of the stated feature or features. This term does not preclude the presence or addition of further features in various embodiments.

It is to be understood that the present invention is not limited to the embodiments described herein and further and additional embodiments within the spirit and scope of the invention will be apparent to the skilled reader from the examples illustrated with reference to the drawings. In particular, the invention may reside in any combination of features described herein, or may reside in alternative embodiments or combinations of these features with known equivalents to given features. Modifications and variations of the example embodiments of the invention discussed above will be apparent to those skilled in the art and may be made without departure of the scope of the invention as defined in the appended claims.

I claim:

1. An abrasive attachment configured to be removably attached to an abrasive apparatus which includes a drive shaft adapted to rotate the attachment, the attachment including a mounting plate, and at least one working surface incorporating one or more abrasive components bonded to a waterproof backing, wherein one side of a working surface is permanently adhered to a surface of the mounting plate using a waterproof adhesive.

2. An abrasive attachment as claimed in claim 1 which includes a pair of flat working surfaces orientated substantially parallel to one another.

3. An abrasive attachment as claimed in claim 1 which includes an annular working surface positioned adjacent to and at an angle to a flat working surface, each working surface incorporating abrasive particles bonded to a waterproof backing.

4. An abrasive attachment as claimed in claim 3 wherein the two angled adjacent working surfaces allow the attachment to be used to abrade two adjacent surfaces at the same time.

5. An abrasive attachment as claimed in claim 3 wherein the flat working surface is applied to an exterior face of the mounting plate and the annular working surface is applied to the rim of the mounting plate.

6. An abrasive attachment as claimed in claim 1 wherein a working surface incorporates abrasive particles bonded to a waterproof backing.

7. An abrasive attachment as claimed in claim 1 wherein the mounting plate is formed by a waterproof foam pad.

8. An abrasive attachment as claimed in claim 1 wherein said abrasive components include any one or combination of steel wool or scouring pad materials.

9. An abrasive attachment as claimed in claim 1 wherein an abrasive component is formed by a cutting blade incorporating a plurality of teeth, and wherein each tooth of the cutting blade is set at the same direction and angle to the body of the cutting blade.

10. An abrasive attachment as claimed in claim 9 wherein the mounting plate forms a levelling element adapted to control the orientation of the cutting blade when used.

* * * * *